US006068510A

United States Patent [19]

Tung

[11] Patent Number: 6,068,510

[45] Date of Patent: May 30, 2000

[54] ELECTRICAL CARD CONNECTOR

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/334,843

[22] Filed: Jun. 16, 1999

[30] Foreign Application Priority Data

Dec. 28, 1998 [TW] Taiwan ..... 87221641

[51] Int. Cl.[7] ..... H01R 13/73

[52] U.S. Cl. ..... 439/567; 439/79

[58] Field of Search ..... 439/567, 64, 79

[56] References Cited

U.S. PATENT DOCUMENTS 5,249,983 10/1993 Hirai ..... 439/567
5,653,596 8/1997 Banakis et al. ..... 439/64
5,820,387 10/1998 Borisch et al. ..... 439/79
5,961,355 10/1999 Morlion et al. ..... 439/79
5,993,263 11/1999 Sampson ..... 439/79

*Primary Examiner*—Gary F. Paumen
*Attorney, Agent, or Firm*—Wei Te Chung

[57] ABSTRACT

An electrical card connector comprises a header, a pair of mounting arms and a locking element. The header has front and rear surfaces for contacting with a circuit board and an electrical card respectively. A number of passageways are defined between the front and rear surface for receiving a number of terminals. A pair of mounting arms extends from opposite lateral ends of the header for being mounted to the circuit board by two locking elements. After assembly, the circuit board is positioned by a pair of projections formed on a bottom surface of the mounting arm. Thus, the height of the assembled circuit board and electrical card connected is reduced, and internal computer.

2 Claims, 2 Drawing Sheets

ELECTRICAL CARD CONNECTOR

BACKGROUND OF THE INVENTION

The present invention relates to an electrical card connector.

An electrical card connector is mounted on a circuit board for receiving an electrical card. Conventionally, the electrical card connector is entirely mounted on the circuit board, thus the electrical card connector will occupy a large amount of space on the circuit board. Moreover, the electrical connector mounted on circuit board will exhibit a height which may be too large for a notebook computer. To reduce the space occupied by the electrical card connector, the electrical card connector may be mounted to an edge of the circuit board. However, the height of the assembled electrical card connector and circuit board still does not change. Also, a plurality of terminals received in the electrical card connector must be precisely mounted on the circuit board. Conventionally, a pair of riveting nuts is used to fix the electrical card connector to the circuit board, which increases assembly time.

BRIEF SUMMARY OF THE INVENTION

Accordingly, an object of the present invention is to provide an electrical card connector having a locking element for facilitating mounting to a circuit board.

To fulfill the above-mentioned object, according to a preferred embodiment of the present invention, an electrical card connector includes a header having front and rear surfaces engaging with an electrical card and a circuit board, respectively. A plurality of passageways is defined between the front and rear surfaces for receiving a plurality of terminals. Each terminal extends beyond the first and second surfaces for electrically contacting with the electrical card and the circuit board. A pair of mounting arms extends from opposite lateral ends of the header, and two projections are defined on a bottom surface of the mounting arms for positioning the circuit board. The mounting arms are thinner than remainder of the card connector. After mounting the card connector to the circuit board, the height of the electrical connector is reduced.

According to are aspect of the present invention, a pair of locking slots is defined in each mounting arm for engaging with a locking element. The locking element has a fixing section, an engaging section and a base section. The fixing section has a pair of legs for securing the electrical card connector to an edge of the circuit board.

DETAILED DESCRIPTION OF THE INVENTION

Figure 1:
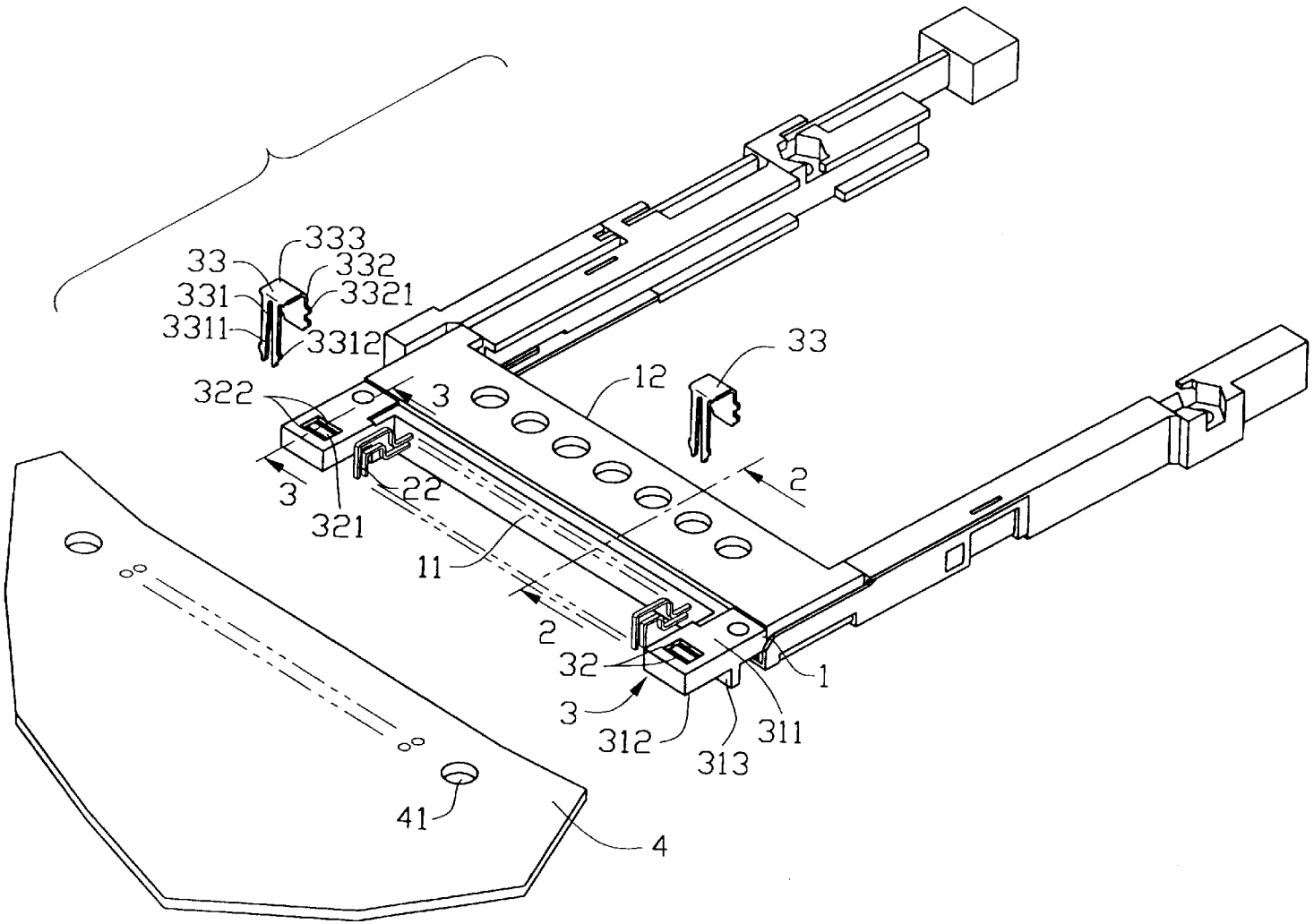
FIG. 1 is a perspective view of a electrical card connector in accordance with the present invention and a circuit board.
Figure 2:
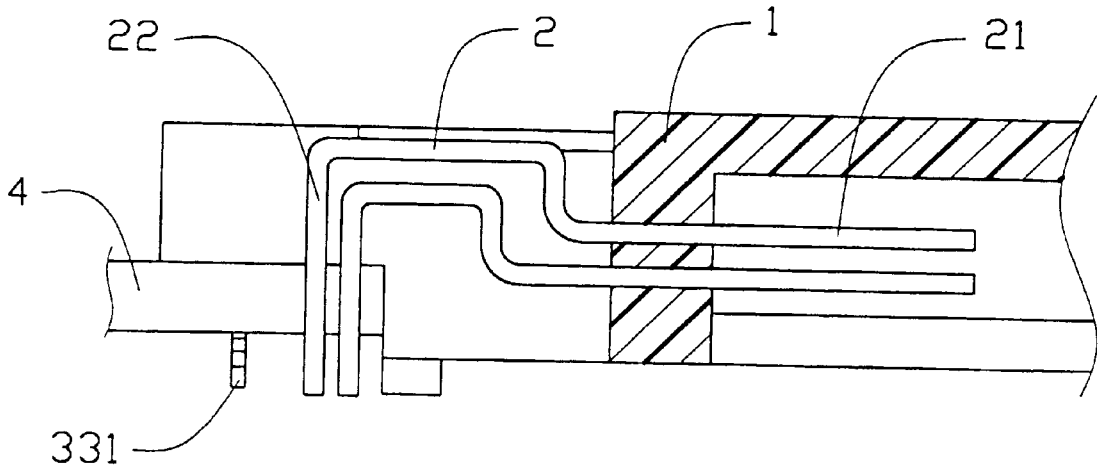
FIG. 2 is a cross-sectional view taken along line 2—2 of FIG. 1.

Referring to FIGS. 1 and 2, an electrical card connector in accordance with a preferred embodiment of the present invention comprises a header 1, a plurality of terminals 2 and a pair of mounting arms 3 extending from opposite lateral ends of the header 1. The header 1 has front and rear surfaces 11, 12 for proximity to a circuit board 4 and an electrical card (not shown), respectively. A plurality of passageways is defined between the front and rear surfaces for receiving the terminals 2 therein. Each terminal 2 has a first contacting section 21 at one end for contacting with the electrical card, and a second contacting section 22 for contacting with the circuit board 4. The mounting arms 3 engage with the circuit board 4. A top surface 311 and a bottom surface 312 are formed on opposite sides of each mounting arm 3. A projection 313 extends from the bottom surface 312 for abutting an end edge of the circuit board 4 when the card connector and the circuit board are assembled thereby positioning the circuit board 4 at a predetermined position relative to the connector. A pair of locking slots 32 is defined through each mounting arm 3 for receiving a locking element 33. In this embodiment the locking slots 32 are parallel to each other, however, alternatively the locking slots 32 can be formed at an angle to each other.

The locking element 33 has a fixing section 331, an engaging section 332 and a base section 333. The fixing section 331 and engaging section 332 extend from opposite edges of the base section 333 in the same direction. A depression 321 is formed in a corresponding mounting arm 3 between the locking slots 32 and below the top surface 311 of the mounting arm 3 for receiving the base section 333 of the locking element 33. An inclined face 322 is formed along an edges of an upper surface 3211 of a wall of the mounting arm 3 between the locking slots 32 for facilitating insertion of the locking element 33 into the mounting arms 3. A pair of locking legs 3311 is formed at an end of the fixing section 331, and a protrusion 3312 is formed on a lateral edge of a bottom of each locking leg 3311 for engaging with a hole 41 of the circuit board 4 and securing the mounting arms 3 to the circuit board 4. The engaging section 332 is shorter than the fixing section 331. The engaging section 332 has a barb-like mating section 3321 on opposite lateral edges thereof for interferentially engaging with the mounting arm 3 for securing the locking element 33 therein.

Figure 3:
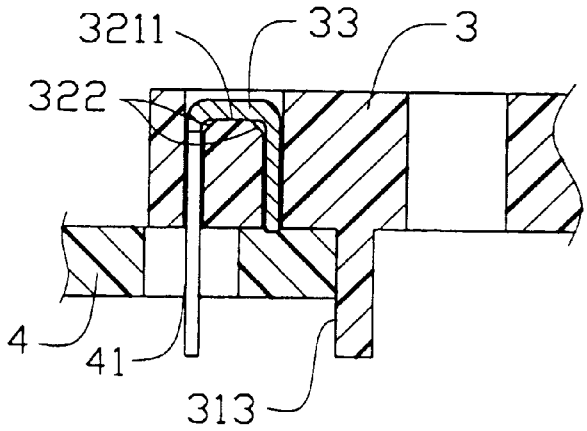
FIG. 3 is a cross-sectional view taken along line 3—3 of FIG. 1.

Referring to FIG. 3, the bottom surfaces 312 of the mounting arms 31 are mounted to the circuit board 4 to a position that the end edge of the cirucit board 4 abuts the projection 313. The locking legs 331 of the locking element 33 are inserted into the locking slots 32 and extend through the hole 41 of the circuit board 4 to securely mount the electrical card connector to the circuit board 4. In the present invention, since the connector is mounted to an edge of the printed circuit board 4, the valuable space of the printed circuit board 4 can be saved for accommodating more electronic components. Furthermore, as a lower portion of the connector is mounted below the printed circuit board (FIG. 2), the profile of the connector above the printed circuit board 4 can be reduced to help the connector to be more suitably fitted in a notebook computer which has a tendency of becoming thinner and thinner.

It is to be understood, however, that ever though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical card connector assembly comprising:

a header having a plurality of passageways for receiving terminals and a pair of mounting arms extending from opposite lateral ends thereof, each mounting arm defining a pair of locking slots; and a pair of locking elements each having a fixing section, an engaging section and a base section interconnected between the fixing section and engaging section, the locking elements extending through the locking slots of the mounting arms and resiliently engaging circuit board holes;

wherein each mounting arm has a top surface, a bottom surface, and a projection downwardly extending from the bottom surface and contacting an edge of the circuit board;

wherein the fixing section is longer than the engaging section and the fixing section has a pair of split legs;

wherein a protrusion is formed at the end of each leg of the fixing section and abuts against the bottom surface of the circuit board to mount the electrical card connector on the circuit board;

wherein the engaging section has a plurality of mating sections formed on lateral edges thereof for securely engaging with the locking slots of the corresponding mounting arm, whereby the electrical card connector is reliably mounted on the circuit board.

2. An electrical card connector assembly comprising:

a header including a plurality of passageways, a corresponding number of terminals received within the corresponding passageways, respectively;

a pair of mounting arms extending from two opposite ends thereof, each of said mounting arms defining a top surface and an bottom surface with a projection downwardly extending therefrom;

a pair of locking elements each including a resilient fixing section and an engaging section, said engaging section secured within the corresponding mounting arm between said top surface and said bottom surface, and the fixing section extending downwardly out of the bottom surface to securely position the electrical card connector; and a circuit board defining an upper surface and a front edge respectively abutting against the bottom surfaces and the projections of the mounting arms, said circuit board including holes respectively receiving the terminals and the fixing sections of the locking elements, the fixing sections resiliently engaging the respective circuit board holes and a bottom surface of the circuit board.

* * * * *